US006862845B2

(12) United States Patent
Schiks

(10) Patent No.: US 6,862,845 B2
(45) Date of Patent: Mar. 8, 2005

(54) DROP-CATCH MECHANISM FOR AN OVERHEAD DOOR

(75) Inventor: Naud Schiks, Huizen (NL)

(73) Assignee: Flexi-Force, B.V., Barneveld (NL)

( * ) Notice: Subject to any disclaimer, the term of this patent is extended or adjusted under 35 U.S.C. 154(b) by 159 days.

(21) Appl. No.: 10/012,888

(22) Filed: Dec. 7, 2001

(65) Prior Publication Data

US 2002/0069585 A1 Jun. 13, 2002

(30) Foreign Application Priority Data

Dec. 7, 2000 (EP) ..... 00204367

(51) Int. Cl.[7] ..... E05F 3/18
(52) U.S. Cl. ..... 49/322; 49/200
(58) Field of Search ..... 160/300; 49/199, 49/200, 322; 16/401

(56) References Cited

U.S. PATENT DOCUMENTS 1,863,961 A * 6/1932 Ball et al. ..... 160/189
3,842,892 A * 10/1974 Stieler ..... 160/133
4,448,290 A * 5/1984 Reid et al. ..... 188/82.7
4,582,179 A * 4/1986 Nelson ..... 188/184
4,997,022 A * 3/1991 Klein ..... 160/265
5,494,093 A * 2/1996 Eiterman ..... 160/300
5,706,552 A * 1/1998 Hsieh ..... 16/82
5,971,055 A * 10/1999 Rohaut ..... 160/300

FOREIGN PATENT DOCUMENTS

DE 84 21 051 U 11/1985
DE 198 55 697 * 2/2000
EP 0 722 031 * 1/1996
EP 0 803 626 A1 10/1997

* cited by examiner

*Primary Examiner*—Gregory J. Strimbu
(74) *Attorney, Agent, or Firm*—Swanson & Bratschun, LLC

(57) ABSTRACT

A drop-catch mechanism for preventing the door leaf of an overhead door from rapidly closing upon breakage of the balancing spring thereof. The drop-catch mechanism having an input member for coupling with the balancing spring of the overhead door, a ratchet wheel for coupling with a winding axle carrying the door leaf of the overhead door, a pawl, and a positive mechanical drive for moving the pawl from a free position that allows rotation of the ratchet wheel to a catching position that blocks rotation of the ratchet wheel, the positive mechanical drive being configured such that, in use, breakage of the balancing spring coupled to the input member causes the pawl to move from the free position to the catching position.

12 Claims, 5 Drawing Sheets

DROP-CATCH MECHANISM FOR AN OVERHEAD DOOR

RELATED APPLICATION DATA

This application claims benefit of European Application Serial Number 00204367.7 entitled "Drop-catch mechanism", filed on Dec. 7, 2000, which application is incorporated herein in its entirety by reference.

BACKGROUND OF THE INVENTION

The invention relates to a drop-catch mechanism for preventing a door leaf of an overhead door from falling down upon breakage of a balancing spring thereof, the mechanism comprising an input member for coupling with a balancing spring of the overhead door, a ratchet wheel for coupling with a winding axle carrying the door leaf of the overhead door, a pawl, and means for moving the pawl from a free position that allows rotation of the ratchet wheel to a catching position that blocks rotation of the ratchet wheel, the means for moving the pawl being configured such that, in use, breakage of a balancing spring coupled to the input member, causes the pawl to move from the free position to the catching position.

Such a drop-catch mechanism is generally known and is used to block rotation of the winding axle of an overhead door to which a singular or articulated door leaf is directly or indirectly coupled, due to a resulting gravitational force on the door leaf upon breakage of a balancing spring.

In use, the input member of the drop-catch mechanism is coupled to a first, stationary end of a pretensioned torsional balancing spring that has a second, rotary end coupled to the winding axle of the overhead door. The ratchet wheel is directly or indirectly coupled to the winding axle, such that it can cooperate with the pawl of the drop-catch mechanism to block rotation of the winding axle.

In the known drop-catch mechanism, the means for moving the pawl between the free position and the blocking position comprise a catch member that is displacably guided between a first position, corresponding to the free position of the pawl, and a second position corresponding to the catching position of the pawl. In use, the balancing spring biasses the catch member into the first position. Upon breakage of the balancing spring, the catch member moves into the second position.

The pawl comprises a lever that extends between a first end that is pivotably carried on the base member and a second end that is laid-up onto the catch member. When the catch member moves from the first position into the second position, it moves away from the second end of the pawl and the pawl is free to move into the catching position under the action of a pawl spring.

A problem associated with the known device is that movement of the catch member from the first into the second position does not by itself ensure movement from the pawl from the free position to the catching position. The catch and the pawl comprise two sequentially disposed drives of which the movement is indirectly coupled. In particular, after the catching member has moved from the first into the second position, the pawl may remain in the free position, e.g. when the pawl spring malfunctions or when the force exerted by the spring is not great enough to overcome friction in the pivot of the pawl, e.g. due to corrosion or built-up dust. Furthermore, the laid-up lever arm of the pawl requires relatively much space, which makes the drop-catch mechanism difficult to use in domestic overhead garage doors, as in a domestic garage normally only a small amount of space is available for the drop-catch mechanism. A typical domestic overhead garage door has e.g. two helically wound torsion springs having a diameter of 44.5 mm (1¾ inch), 51 mm (2 inch) or 67 mm (2⅝ inch), a tubular winding axle having a diameter of approximately 25.4 mm (1 inch) and a maximum door leaf weight of 87 kg per spring. For domestic overhead garage doors, the reliability of the drop-catch mechanism is especially important, as these doors are in practice not always subject to the prescribed regular safety inspection.

BRIEF SUMMARY OF THE INVENTION

The object of the invention is to provide a drop-catch mechanism having an alternative construction. In particular, it is an object to provide for a drop-catch mechanism of alternative construction that allows increased reliability and that requires less building space, such that it is suitable for use in a domestic garage door.

This objective is achieved by using a positive mechanical drive extending from the input to the pawl it is ensured that movement of the stationary end of the spring is directly transmitted by the mechanism to the pawl. Due to the positive mechanical drive directly coupling the movement of the stationary end of the spring and the pawl, the chance of malfunction o the movement of the pawl due to corrosion or dust-build-up is decreased. Compared to the prior art, the positive mechanical drive extending from the input member to the pawl obviates the need for a secondary, sequential drive for the pawl, thus increasing reliability. Furthermore, the positive mechanical drive allows for a more compact and simplified construction that can be assembled in a fool-proof fashion.

Preferably, the mechanical drive comprises a base member, relative to which the input member is rotationally disposed, such that it can rotate about a central axis from a first stop corresponding to the free position to a second stop corresponding to a catching position while the relative rotational movement between the input member and the base member drives the pawl from the free position into the catching position. By using the relative rotational movement of the input member and the base member, a compact and reliable construction can be achieved. In use, the balancing spring can bias the input member towards the first stop, while an auxiliary spring can be used to drive the input member towards the second stop. Advantageously, the input member carries a plug for connection of the stationary end of a helically wound torsional balancing spring, while the base member may serve to mount the bearing of the winding axis of the overhead door and/or may be provided with means for fixing the mechanism to a fixed construction.

The pawl may be fixedly carried on the input member, such that the pawl directly engages the ratchet wheel when the input member rotates from the first stop towards the second stop. This allows for a simple and compact construction.

The pawl may also be embodied as a lever. Preferably, the lever is rotatably connected to the input member and/or the base member, such that a rotational axis thereof extends substantially parallel to the central axis, while the input member and/or the base member comprises a driving member arranged for the positive driving engagement with the lever. This way, in case of breakage of the spring, the relative rotational movement of the base member and the input member can efficiently and reliably be transferred to an engaging movement of the pawl. The lever can e.g. be rotatably connected to both the input member and the base member via a central pivot axis, while the input member and the base member each comprise a driving pin, e.g. for moving the pawl from the free position into the catching position and vice versa. As an alternative, the lever can be carried on a pivot axis carried on the output member of input member only, while respectively the base member or the input member is provided with a driving pin for driving the pawl from the free position into the catching position in case of relative rotational movement of the input member and the base member after breakage of the torsional spring.

In a further embodiment, the lever comprises at least two lever arms extending from a pivot portion, e.g. formed as an aperture journalled on a pivot axle. Such lever arms may extend along a straight line but may also enclose an angle of less than 180°. This way, the mechanism can be compressed even further. A third or further lever arm may be provided. e.g. for engagement of an auxiliary spring or engagement of a contact breaker circuit.

In a still further embodiment, the input member and the base member each comprise a plate like portion extending substantially perpendicularly to the central axis the plate-like portions being axially spaced along the central axis by means of at least two spacing members, the lever and the ratchet wheel being interposed between the plate-like portions. This way, the construction of the mechanism can be further compacted, while the plate-like portions form a shielding for the lever and the ratchet wheel.

By providing the lever with at least one slot for sliding engagement with a driving member, the reliability of the mechanism can be further increased. In particular, the slot prevents accidental disengagement of the lever and the driving member. In addition, the slot ensures a positive mechanical drive when returning the pawl from the catching position towards the free position.

Preferably, at least one of the spacing members forms a driving member, while the spacing member is guided in a slot in one of the plate-like portions. This further reduces the constructional space needed for the mechanism.

In a still further embodiment, at least one of the spacing members is provided with one or more flanges for supporting the spacing member on the area surrounding the slot. This way, play in a direction parallel to the central axis can be minimized, while the assembly of the mechanism can be facilitated.

The invention further relates to an overhead door and a kit of parts for assembling a drop-catch mechanism.

Further preferred embodiments are described in the appended claims.

BRIEF DESCRIPTION OF THE DRAWINGS

The invention will be elucidated further by means of a drawing. In the drawing is.

The drawings are only schematical representations of an exemplary embodiment of the invention. In the drawings, identical or corresponding parts are identified with the same reference numerals.

DETAILED DESCRIPTION OF THE PREFERRED EMBODIMENT

Figure 1:
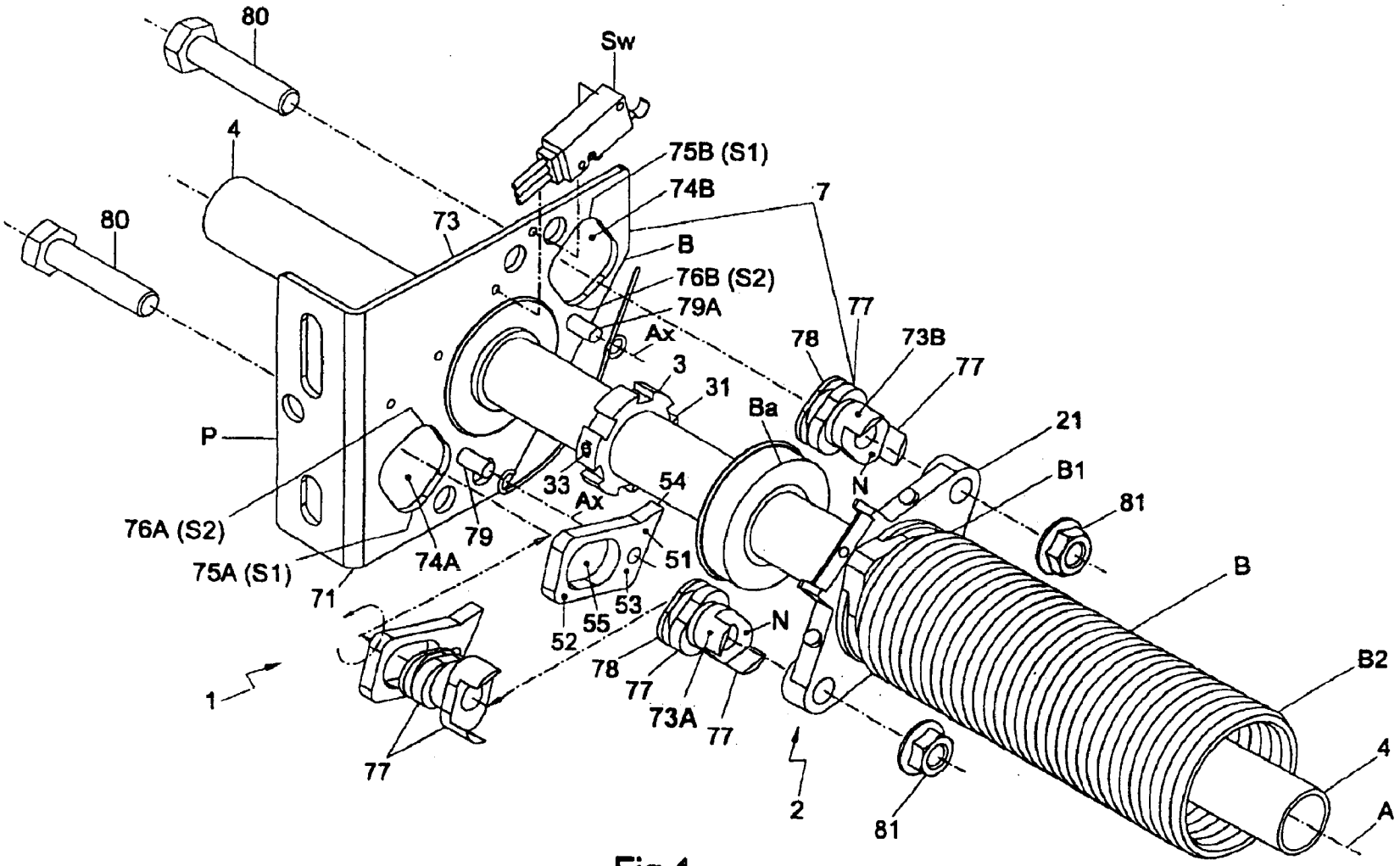
FIG. 1 an exploded view of a drop-catch mechanism according to the invention.

FIG. 1 shows an exploded view of the drop-catch mechanism 1. The mechanism 1 comprises an input member 2 for coupling with a first, stationary end B1 of a balancing spring B of an overhead door. The rotary end B2 of the balancing spring is fixedly coupled to the winding axle 4. The mechanism further comprises a ratchet wheel 3 for coupling with a winding axle 4. To enhance clarity, FIG. 1 only shows a small part of the winding axle 4.

Figure 2A:
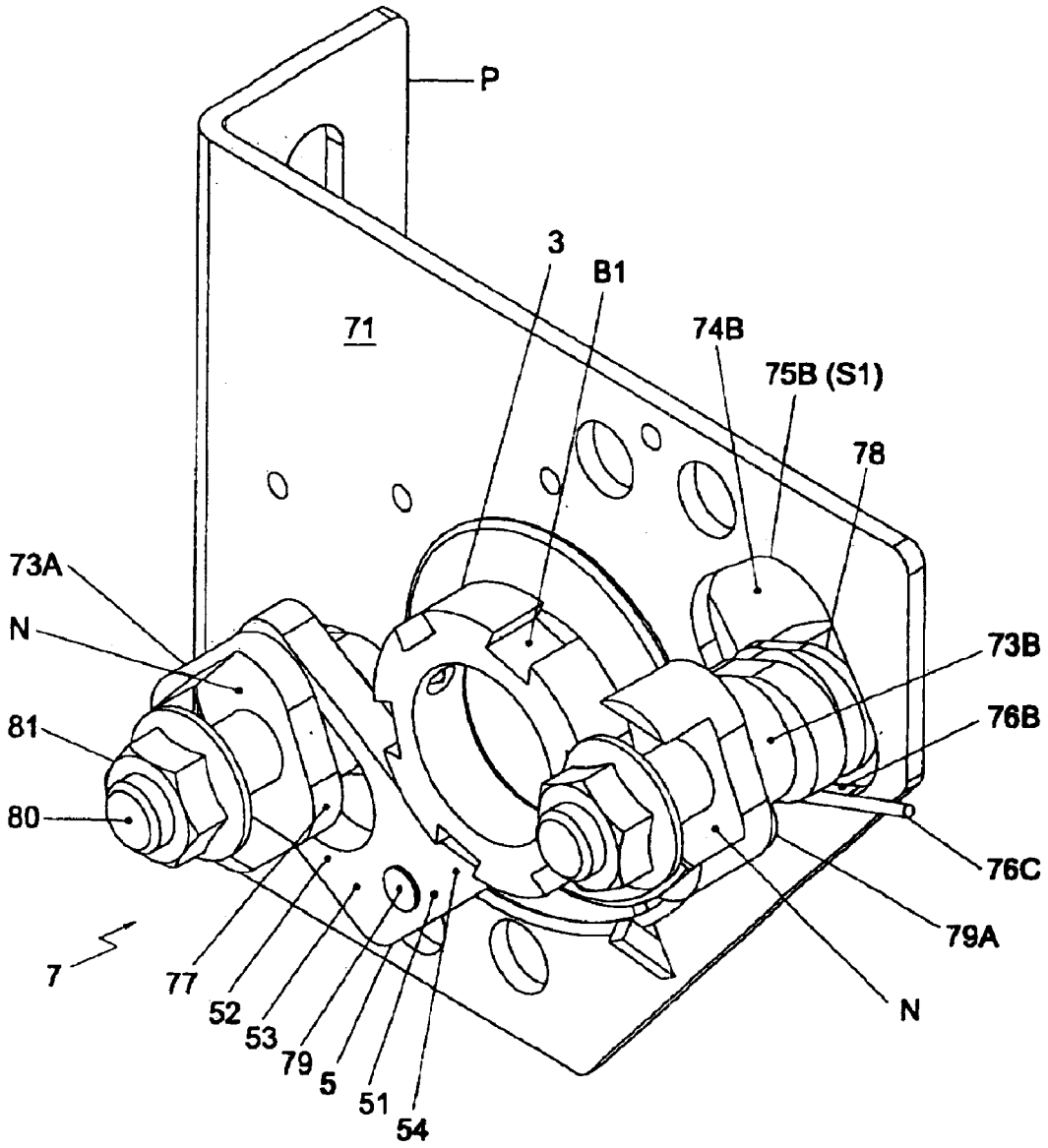
FIG. 2A a perspective view of the drop-catch mechanism of FIG. 1 in assembled condition in a free position without the input member.
Figure 2B:
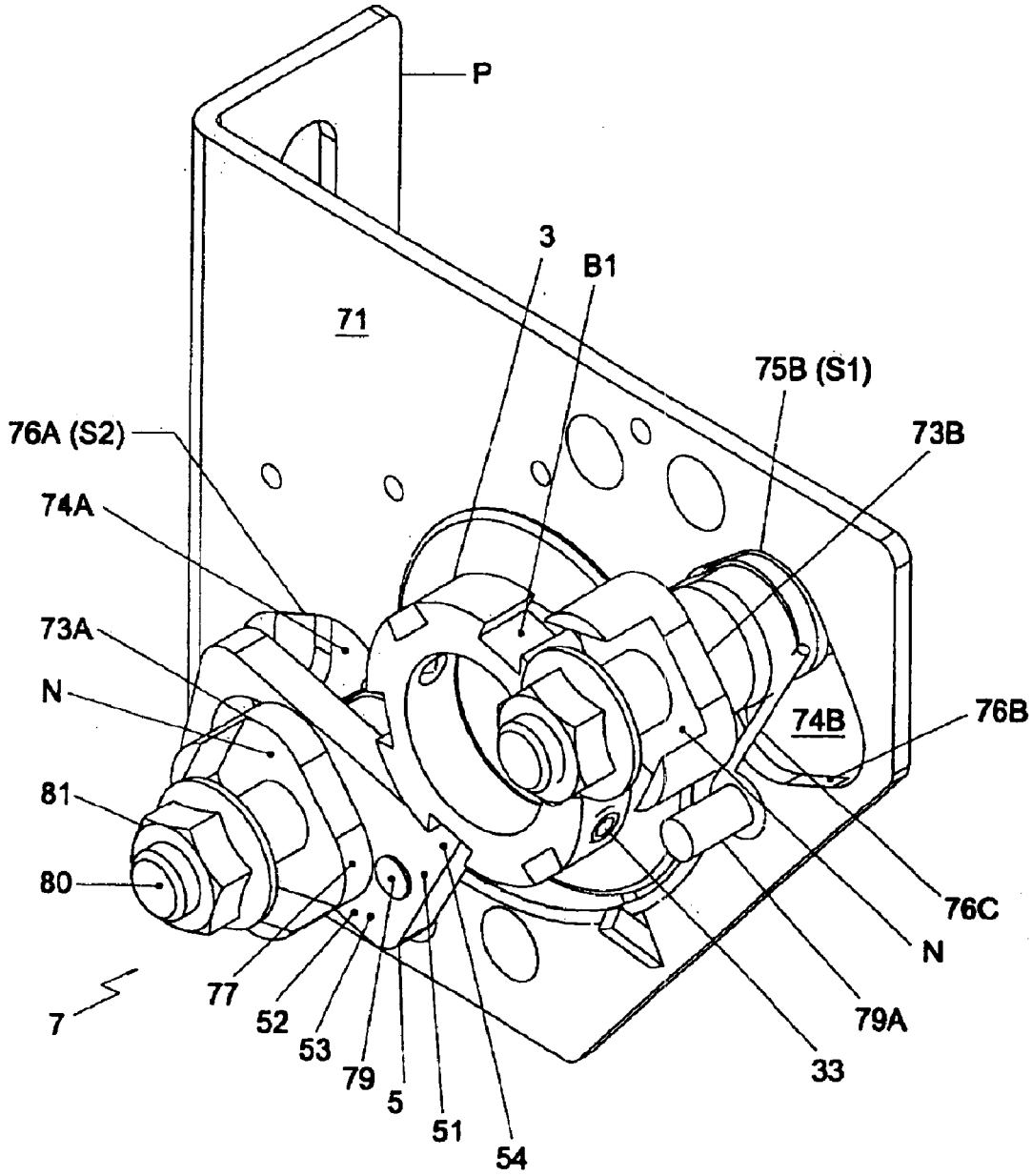
FIG. 2B a perspective view of the drop-catch mechanism of FIG. 1 in assembled condition in a catching position without the input member.
Figure 3A:
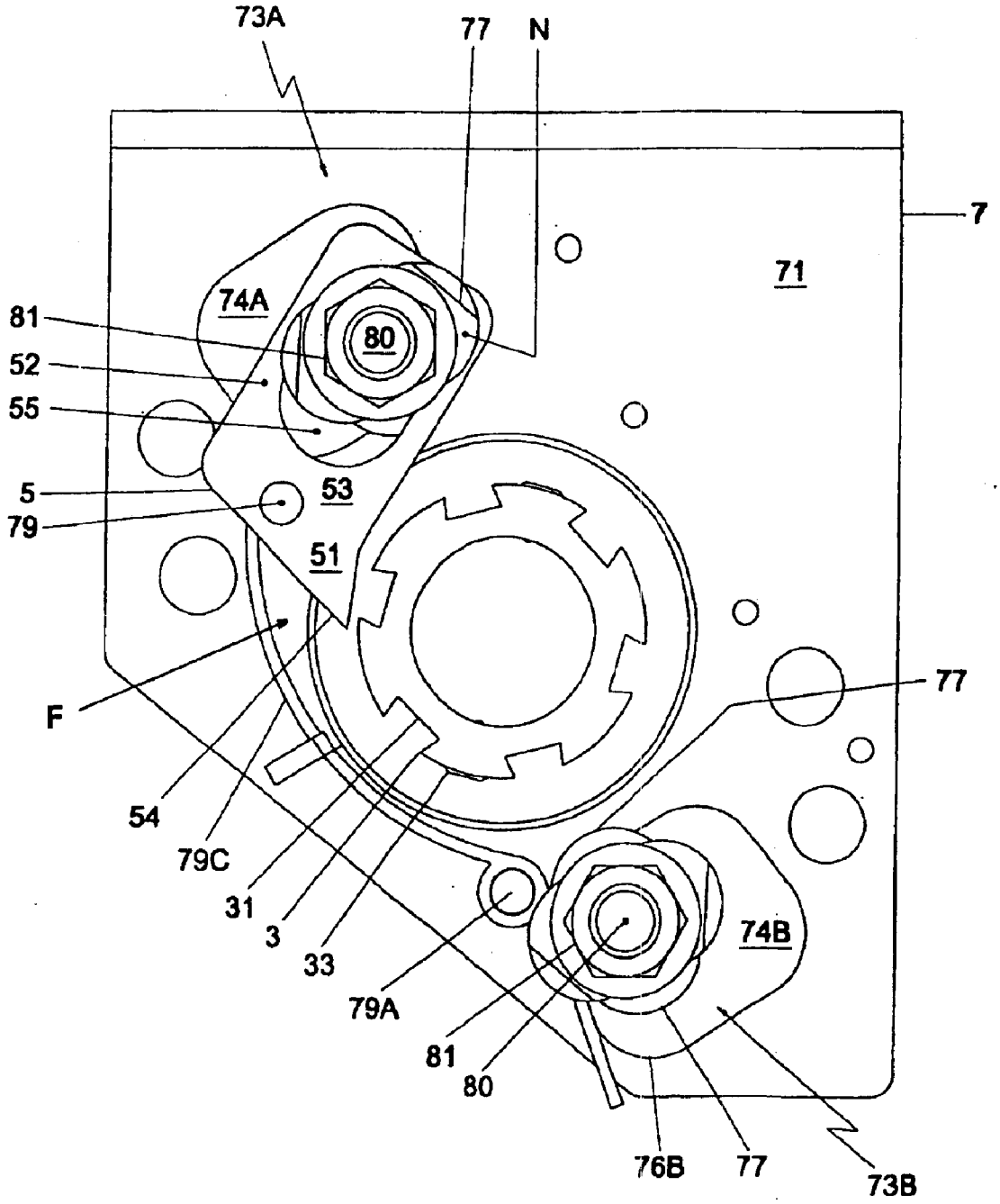
FIG. 3A a plan view of the drop-catch mechanism of FIG. 2A.
Figure 3B:
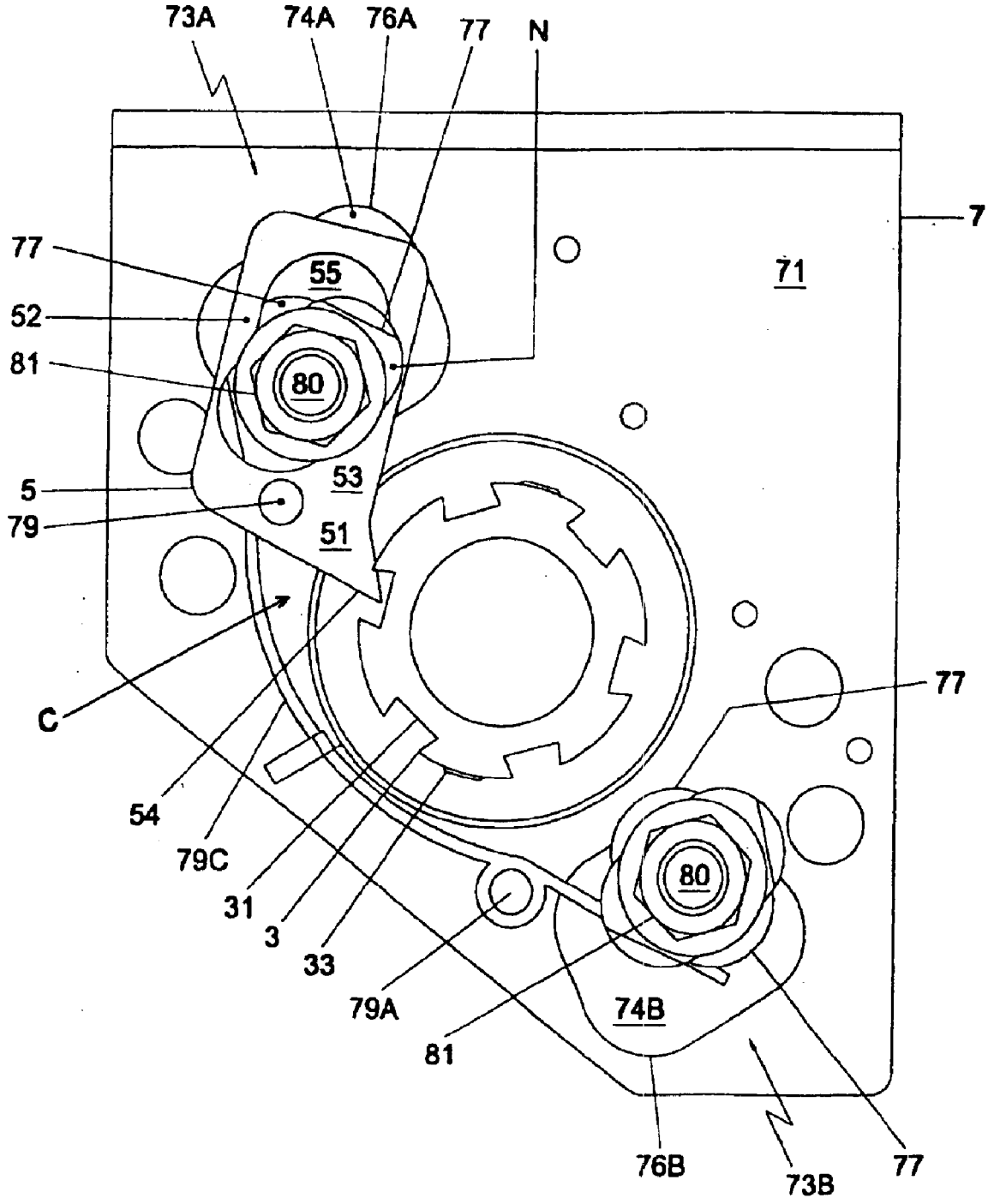
FIG. 3B a plan view of the drop-catch mechanism of FIG. 2B.

The mechanism 1 further comprises a pawl 5 and means for moving the pawl 5 between a free position F that allows rotation of the ratchet wheel 3 and a catching position C that blocks rotation of the ratchet wheel 3. The means for moving the pawl are configured such that, in use, breakage of a balancing spring coupled to the input member 2 causes the pawl 5 to move from the free position F to the catching position C shown in the FIGS. 2–3.

According to the invention, the means for moving the pawl comprise a positive mechanical drive 7 extending from the input member 2 to the pawl 5.

The positive mechanical drive 7 comprises a base member 71. The input member 2 is rotationally disposed relative to the base member 71, such that it can rotate about a central axis A from a first stop S1 corresponding to the free position F of the pawl 5 to a second stop S2 (shown in FIGS. 2A, 3A and 2B, 3B respectively) corresponding to a catching position C of the pawl 5, while the relative rotational movement between the base member 71 and the input member 2 directly drives the pawl 5 from the free position F into the catching position C.

To allow relative rotational movement, in this embodiment, the base member 71 comprises a plate-like portion 73 extending substantially perpendicular to the central axis A, while the input member 2 comprises a plate-like portion 21. The plate-like portions 21, 71 are axially spaced on the central axis A by means of two spacing members 73A, 73B carried on the plate-like portion 21 of the input member 2. The spacing members 73A, 73B are slidably engaged in slots 74A, 74B in the plate-like portion 72 of the base member 71.

In use, the stationary end of a helically wound, torsional balancing spring biases the spacing members 73A, 73B to the edges 75A, 75B of the slots 74A, 74B that define the first stop S1. Upon breakage of the balancing spring, the loss of the biasing force causes the input member 2 to rotate against the biasing direction about the central axis A, such that the spacing members 73A, 73B are guided by the slots 74A, 74B towards edges 76A, 76B that define the second stop S2. The movement from the first stop S1 towards the second stop S2 will take place automatically due to recoil action of the broken balancing spring, but may be assisted by an auxiliary spring 76C that engages one of the spacing members 73A or 73B and that urges the input member 2 to rotate towards the second stop S2. Furthermore, the auxiliary spring ensures rotation towards the second stop S2 if the balancing spring breaks at the stationary end and no recoil action is generated. In use, the biasing force of the balancing spring is chosen greater than the biasing force of the auxiliary spring 76C to ensure that, while the balancing spring is intact, the input member 2 stays at the second stop S2. To center the rotational movement from the first stop to the second stop about the central axis A, a ball bearing Ba is provided on the input member 2.

To support the spacing members 73A, 73B on the area surrounding the slots and to reduce axial play, the spacing members 73A, 73B are provided with ellipsoidal flanges 77, 78 and are axially locked in the slots 74A, 74B between flanges 77 and 78.

The pawl 5 and the ratchet wheel 3 are interposed between the plate-like portion 21 of the input member 2 and the plate-like portion 72 of the base member 71. The pawl 5 is configured as a lever having a first lever arm 51 and a second lever arm 52, each extending from a pivot portion 53. The pivot portion 53 comprises a bearing for a pivot axle 79 carried on the plate-like portion 72 of the base member 71.

The first lever arm 51 comprises a wedge-shaped tip 54 that is shaped to blockingly cooperate with notches 31 on the circumference of the ratchet wheel 3. The second lever arm 52 comprises a slot 55 for sliding engagement with the spacing member 73A. The spacing member 73A forms a driving member that, upon movement of the input member 2 from the first stop S1 to the second stop S2 positively drives the pawl 5 from the free position F into the catching position C. In particular, the spacing member 73A engages the second lever arm 52, such that the pawl 5 pivots with its pivot portion 53 about the pivot axis Ax and the first lever 51 arm carrying the tip 54 engages a notch 31 of the ratchet wheel 3. As clearly shown in FIG. 3 the ratchet wheel 3 is now blocked against rotation about the central axis Ax. As the ratchet wheel 3 fixed to the winding axle 4 by means of screws 33, the winding axle 4 is also blocked against rotation and the door leaf carried on the winding axle 4 is stopped from falling down. To provide for a reliable fixture, the ratchet wheel is fixed to the winding axle by means of a screw. Preferably, at least two screws 33 are used, one of which carries a tip that engages a radial bore in the winding axle. The slot 55 allows a positive drive both from the free position into the catching position and vice versa.

The bolts 80 extend through the spacing members 73A, 73B and the input member 2, such that the mechanism can be assembled without axial play by tightening nuts 81.

The plate-like portion 72 of the base member 71 carries an additional pivot axle 79A diametrically opposed from the central axis A, such that the base member 71 can be used both for a left hand and a right hand drop-catch mechanism on the winding axle 4. To this end, also the spring 76C, the spacing members 73A, 73B, the pawl 5 and the ratchet wheel 3 are designed to be suitable for both left and right hand use input plate 2.

The base member 71 is provided with a hooked portion P provided with mounting apertures, such that it can be mounted against a fixed construction, e.g. a portion of a wall above a door opening, a ceiling or a portion of a track that guides the door leaf.

By providing the spacing members 73A, 73B with notches N, the plate-like portion 21 of the input plate 2 can engage the spacing members 73A, 73B more securely.

Preferably, the flange 77 on the spacing member 73A has an elongate shape, such that the spacing member 73A can be rotated between a position in which the flange 77 can pass through the slot 55 in the second lever arm 52 of the pawl 5 and a position wherein it extends beyond the slot 55 and axial passage through the slot 55 is prevented. An additional flange 77 is provided on the spacing member 73A, 73B to axially lock the pawl 5 onto the plate like portion 71.

By providing the base member 71 with a bevelled side B the amount of constructional space needed can be further decreased. To prevent overloading the electrical motor of the overhead door after breakage of the balancing spring, the drop-catch mechanism may be provided with an electrical cut off switch Sw that is activated when the input member moves from the first stop S1 towards the second stop S2.

The overall construction of an overhead door is not elucidated further, as such construction is known to the skilled man. Examples of such constructions are e.g. given in U.S. Pat. No. 5,638,640, the contents of which are incorporated herein by reference.

The invention is not limited to the preferred embodiment discussed above. Many variations are possible within the scope of the invention as defined in the appended claims.

What is claimed is:

1. A drop-catch mechanism comprising:

an input member fixedly coupled to a balancing spring of an overhead door for rotational movement with the balancing spring upon breakage of the balancing spring;

a ratchet wheel fixedly coupled to a winding axle carrying a door leaf of the overhead door;

a pawl operatively associated with the ratchet wheel; and a positive driving member directly connected to the input member and the pawl and moving the pawl from a free position which allows rotation of the ratchet wheel to a catching position which blocks rotation of the ratchet wheel upon breakage of the balancing spring, the breakage of the balancing spring causing rotation of the input member and movement of the positive driving member to move the pawl from the free position to the catching position.

2. The drop-catch mechanism of claim 1, further comprising a positive mechanical drive, the positive mechanical drive comprising a base member, relative to which the input member is rotationally disposed, and the positive driving member, the input member being rotatable about a central axis to move the driving member which drives the pawl from a first stop corresponding to the free position to a second stop corresponding to the catching position.

3. The drop-catch mechanism of claim 2, wherein the pawl is fixedly carried on the input member.

4. The drop-catch mechanism of claim 2, wherein the pawl comprises a lever.

5. The drop-catch mechanism of claim 4, wherein:

the lever is rotatably connected to the base member such that a rotational axis of the lever extends substantially parallel to the central axis.

6. The drop-catch mechanism of claim 5, wherein the lever has at least one slot formed therein for sliding engagement with the positive driving member.

7. The drop-catch mechanism of claim 4, wherein the input member and the base member each comprise a substantially planar portion extending substantially perpendicular to the central axis, the substantially planar portions being axially spaced on the central axis, the lever and the ratchet wheel being interposed between the substantially planar portions.

8. The drop-catch mechanism of claim 7, wherein the positive driving member forms a spacing member.

9. The drop-catch mechanism of claim 8, wherein the spacing members is guided in a slot formed in one of the substantially planar portions.

10. The drop-catch mechanism of claim 9, wherein the spacing members includes one or more flanges for supporting the spacing member on an area surrounding the slot.

11. The drop-catch mechanism of claim 1, wherein the pawl comprises at least two lever arms extending from a pivot portion.

12. An overhead door, comprising a drop-catch mechanism comprising:

a door leaf;

a winding axle carrying the door leaf;

an input member;

a pawl;

a ratchet wheel being rotationally coupled to the winding axle and disposed for cooperation with the pawl;

at least one balancing spring having a rotary end coupled to the winding axle and a stationary end fixedly coupled to the input member; and means for directly linking the input member and the pawl and for moving the pawl from a free position, which allows rotation of the ratchet wheel, to a catching position, which blocks rotation of the ratchet wheel upon breakage of the balancing spring.

* * * * *